United States Patent [19]

Pariani et al.

[11] 4,243,209

[45] Jan. 6, 1981

[54] MULTIPLE LEVEL REFRACTORY HEARTH FOR VERTICAL SHAFT METAL MELTING FURNACES

[75] Inventors: Ronald L. Pariani, Pensacola, Fla.; David F. Arp, Carrollton, Ga.

[73] Assignee: Southwire Company, Carrollton, Ga.

[21] Appl. No.: 88,263

[22] Filed: Oct. 25, 1979

[51] Int. Cl.[3] ..... F27B 1/14

[52] U.S. Cl. ..... 266/219; 266/900

[58] Field of Search ..... 266/900, 219; 75/43, 75/44 R, 44 S, 65 R

[56] References Cited

U.S. PATENT DOCUMENTS

| | | | |
|---|---|---|---|
| 1,817,784 | 8/1931 | Valentine | 75/43 |
| 3,788,623 | 1/1974 | Vogel | 266/900 |
| 3,948,642 | 4/1976 | Gross | 75/65 R |

*Primary Examiner*—M. J. Andrews

*Attorney, Agent, or Firm*—Herbert M. Hanegan; Stanley L. Tate; Robert S. Linne

[57] ABSTRACT

Disclosed herein is a method and an apparatus for improving the efficiency of conventional vertical shaft metal melting and refining furnaces by novel refractory arrangements to form a multiple level hearth which will support pieces of metal that have reached the hearth without being melted. With this invention there is even and complete distribution and diffusion of heat around and through these unmelted pieces of metal to effect their rapid melting. Thus unmelted pieces of metal cannot block burners or clog tapping outlets of vertical shaft furnaces, and undue restriction to the flow of molten metal in and from these furnaces is substantially avoided.

6 Claims, 3 Drawing Figures

MULTIPLE LEVEL REFRACTORY HEARTH FOR VERTICAL SHAFT METAL MELTING FURNACES

BACKGROUND OF THE INVENTION

1. Field of the Invention

In general, this invention relates to a method and apparatus for continuously or semicontinuously melting and refining metal in a vertical shaft furnace by contacting the metal pieces with heat produced by the combustion of a fuel mixture having a carefully controlled composition which is burned and injected into the furnace through a plurality of burner openings in the refractory brick furnace wall. Melted metal drains to the bottom of the furnace and flows out of the furnace through a tapping outlet in a substantially continuous stream for further processing.

2. Description of the Prior Art

Conventional vertical shaft furnaces for melting and refining metal, such as copper, are well known; and may hearth arrangements have been used in them for various reasons. Such vertical furnaces and hearth arrangements are disclosed in U.S. Pat. Nos. 2,283,163, 3,199,977, 3,715,203, 3,788,623 and in some of the prior art cited in these. Generally, these furnaces have a substantially cylindrical shape and are elongated in a vertical direction. The metal to be melted, such as copper cathode pieces, is charged into the furnace from an elevated position. These charge pieces drop toward the bottom of the furnace where a plurality of burners located in the walls of the furnace inject heat into the furnace to cause the metal to melt. The molten metal is continuously drained from the furnace through a suitable tapping outlet in the bottom of the furnace and then usually passes to a holding furnace or to a further process such as a continuous casting operation.

Refractory walls of a conventional vertical shaft furnace typically increase in thickness from the upper portion of the furnace to the lower portion of the furnace. This often forms a funnel-shaped interior melting chamber extending from the charge entrance to an area adjacent to the top of the hearth. The funnel-shaped refractory provides continuing support for charge pieces as they melt, shrink and travel down the shaft of the furnace. This support usually works very well for normally large charge pieces such as copper cathodes. However, when the charge is initially smaller than the smallest portion of the funnel; such as copper scrap, blister cakes, spent anodes and the like; or when the charge pieces shrink to a smaller size during continuous melting, and particularly during problem periods which cause repeated startups and shutdowns, the funnel support method is ineffective. The result is unmelted metal pieces resting directly on the hearth, which can easily lead to several problems in the melting and refining process.

One problem encountered with prior art vertical shaft furnaces and their hearth arrangements is that burner openings through which heat enters the furnace can become substantially blocked by the pieces of metal which reach the hearth before they are completely melted. A blocked burner may misdirect heat which will result in inefficient melting and may lead to further blockage. Blocked burners may even blackfire, which often causes malfunctions and damage to the burners and adjacent parts. If pieces of metal mechanically blocks off a burner, incomplete combustion may result. This is considered particularly undesirable because, especially in molten copper, oxygen content is critical. Since the burner ignites a mixture of fuel and oxygen-containing gases, incomplete combustion results in excess oxygen being injected into the furnace and oxygen content in the molten metal could therefore be raised above desirable or acceptable limits. In addition, stagnant pools of molten metal may accumulate allowing formation or concentration of slag, which even if quickly corrected causes poor quality products because slag particles cannot be evenly dispersed again. In extreme cases, shut down, cold cleaning and rebuilding of the furnace may be required.

These problems, and the complications stemming from them, cause significant economic loss because of poor quality copper produced, impaired production, and excessive expenditures of time and money to repair clogged and damaged furnaces.

SUMMARY OF THE INVENTION

The present invention solves these problems by providing a direct support slightly above the hearth for charge pieces which have reached the hearth area without being melted.

Charge consisting of pieces of metal such as copper cathodes, copper scrap, blister cakes, spent anodes and the like or a combination of any or all of these is admitted to the top of the vertical shaft furnace in a continuous or semicontinuous manner. When possible, the metal should be charged in an irregular, unaligned and mixed fashion to provide an uncompact charge with spaces between the pieces of metal for even heat distribution thus increasing melting rate. As the metal melts it often leaves the solid pieces and flows down past the funnel-shaped interior refractory walls to the hearth and out the tapping outlet to another processing stage in a continuous or semicontinuous manner. At the same time, the metal pieces in the support funnel become smaller and slowly travel down the funnel until they are completely molten or until they are small enough to drop through the smallest portion of the funnel. Pieces which attain this size without completely melting, then drop onto the novel multiple level hearth of the present invention.

The multiple level hearth is designed to separate the molten and solid metal. Molten metal flows to the lower levels of the hearth which lead to the tapping outlet adjacent to the lowest level of the hearth. Upper levels of the hearth provide support for solid and semisolid pieces of metal. Heat is therefore distributed evenly and effectively around the supported pieces and quickly reduces them to a molten state. Thus this invention allows molten metal to flow down and out of the furnace substantially unrestricted by solid metal pieces. The furnace tapping outlet will not become clogged by solid metal pieces and the possibility of metal blocking burners in the lower wall of the furnace is greatly decreased.

Thus it is an object of the present invention to provide a method and an apparatus for supporting pieces of metal which have reached the hearth area of a conventional vertical shaft copper melting and refining furnace without being entirely melted.

Another object of this invention is to expand the usefulness of the conventional vertical shaft furnace to include processing irregular pieces of metal such as copper scrap, blister cakes, spent anodes and the like, without increasing the blockage problems usually associated with melting and refining smaller pieces of charge.

Another object of the present invention is to provide even and complete distribution and diffusion of heat around and through pieces of metal which have reached the hearth area without being melted so as to effect their rapid melting.

Still another object of this invention is to avoid undue restriction of gravity flow of molten metal from the vertical shaft furnace to subsequent processing areas by assuring that the metal remains able to flow freely across the hearth and that the tapping outlet does not become clogged by unmelted metal pieces.

Yet another object of this invention is to avoid blocking the lower burners of the vertical shaft furnace, thereby avoiding incomplete combustion of the fuel and oxygen-containing gas which, in turn, avoids the resulting poor quality finished product and damage to the furnace due to misdirected heat or burner backfires.

Another object of the present invention is to provide more precise control over the melting rate of metal in a vertical shaft furnace in order to provide the continuous and regular flow of molten metal which is essential in integrated processes where the metal is used in subsequent continuous operations such as continuous casting and rolling of rod.

Still another object of this invention is to improve the chemical composition of the finished product and render it subject to more exact control by increasing the uniformity and predictability of the melting and refining process.

BRIEF DESCRIPTION OF THE DRAWINGS

While the specification concludes with claims particularly pointing out and distinctly claiming the subject matter which is regarded as this invention, it is believed that the invention, objects, features and advantages thereof will be better understood from the following description taken in connection with the accompanied drawings in which like parts are given like reference numerals and wherein:

DESCRIPTION OF THE PREFERRED EMBODIMENTS

Figure 1:
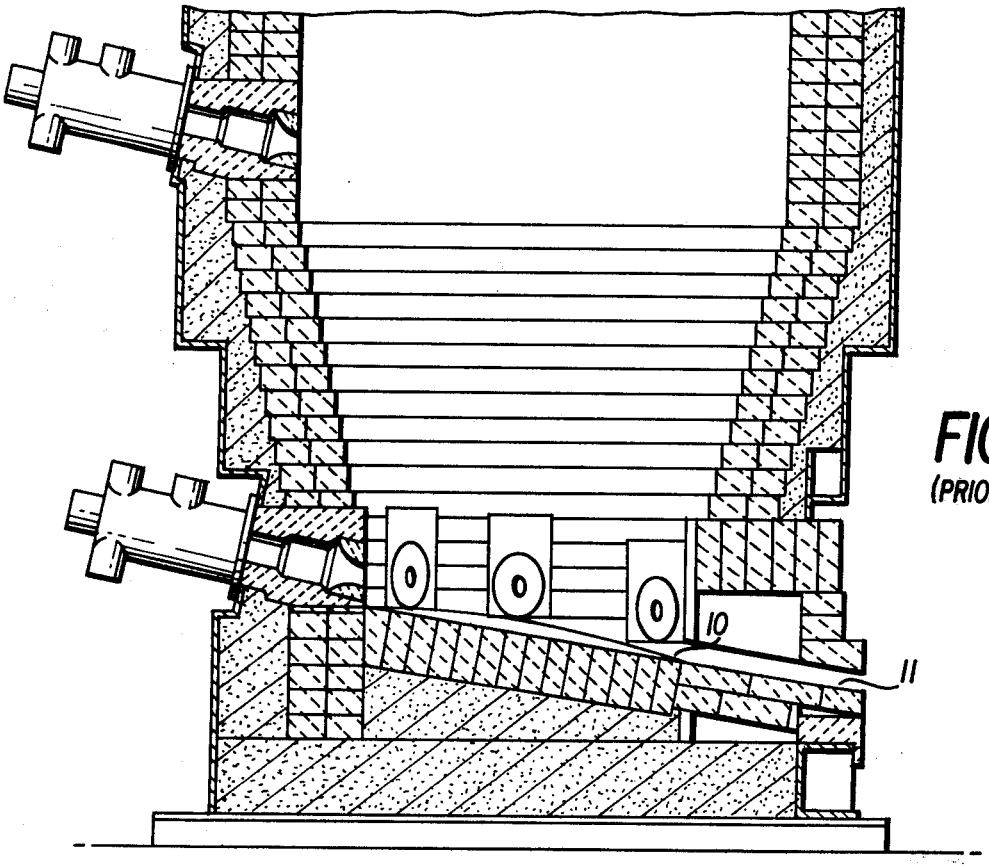
FIG. 1 (PRIOR ART)
FIG. 1 is a cross-sectional view of the lower portion of a conventional prior art vertical shaft furnace.

FIG. 1 illustrates a conventional prior art vertical shaft furnace hearth 10. The hearth 10 usually slants toward the tapping outlet 11 and may be flat or have a slightly convex surface. This hearth 10 has insufficient surface level variation to provide support for any unmelted charge pieces which reach this area. Some type of support is needed to prevent undue restriction of molten copper flow and/or clogging of the tapping outlet 11.

As the following drawings show, there are several possible embodiments of the present invention. Combinations of basic design factors; dome, dish, smooth surface and protrusions, are used to construct the various embodiments. In all variations the top or upper level of the hearth is for charge support while the bottom or lower level is for molten metal discharge.

Figure 2:
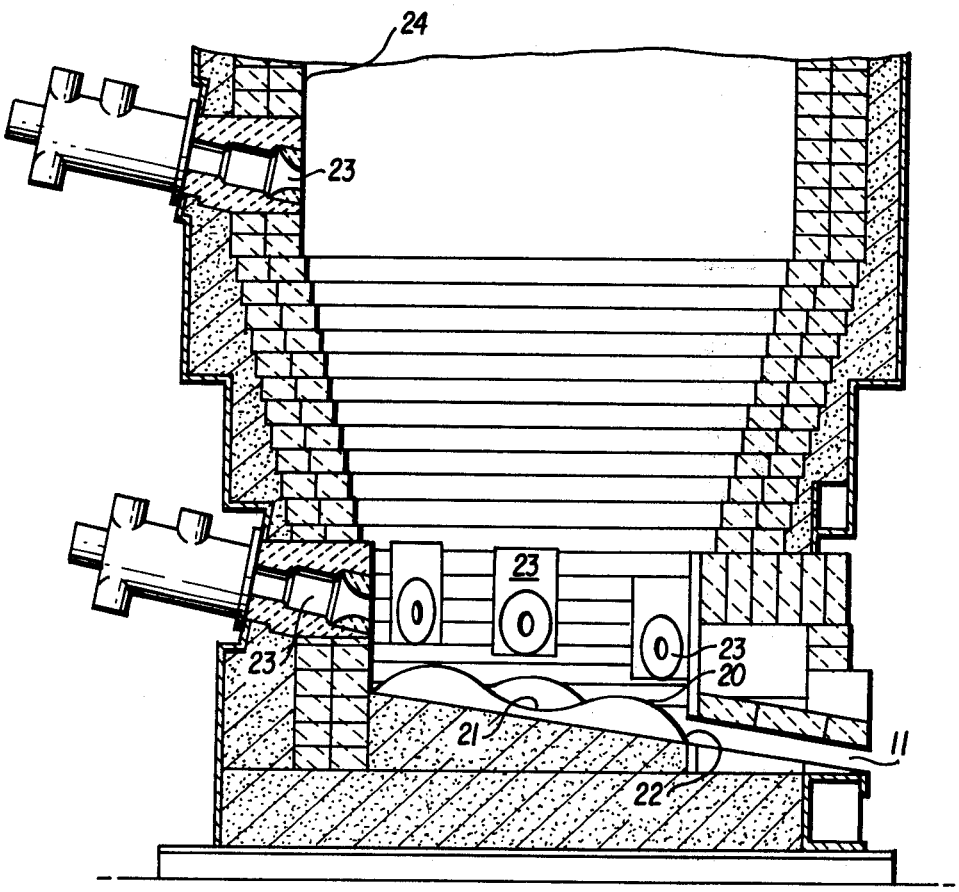
FIG. 2 is a cross-sectional view of a first preferred embodiment of the present invention.

FIG. 2 is one preferred embodiment of the present invention adapted to a sloped hearth similar to the one shown in FIG. 1. It comprises multiple dome 20 and dish components 21 which form a multiple level hearth. Unmelted metal pieces are held above the dish components 21 by the dome components 20. As the pieces of charge melt from heat injected by a plurality of burners 23 located in the refractory walls 24 of the vertical shaft furnace, molten metal flows down and around the domes 20 and through the dish depressions 21 to the tapping outlet 11. The multiple level hearth is situated horizontally unlevel so that point 22, adjacent to the tapping outlet 11, is the lowest level of the multiple level hearth to assure no molten metal accumulation within the furnace.

Figure 3:
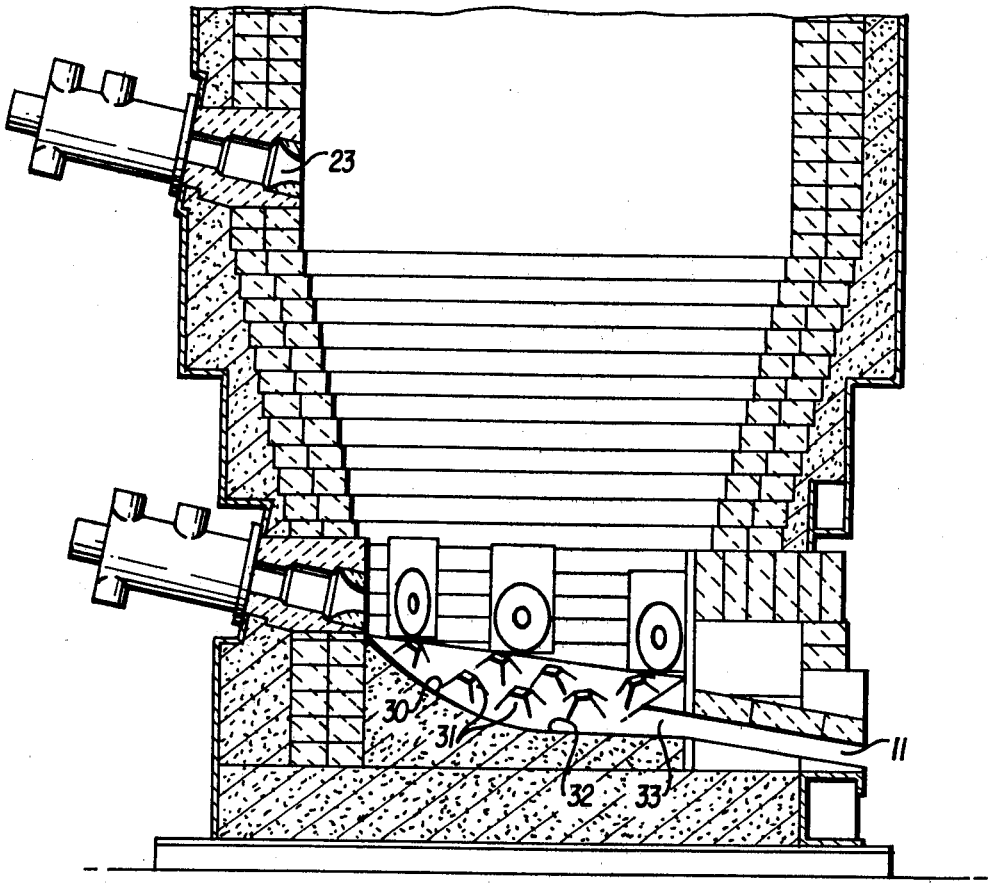
FIG. 3 is a cross-sectional view of a second preferred embodiment of the present invention.

FIG. 3 is another preferred embodiment of the present invention. It is basically of dish 30 shape with a multiplicity of protruding charge support refractory elements 31. When solid pieces of charge reach this multiple level hearth 32, the protruding charge support refractory elements 31 separate them from molten metal by holding them above the dish shaped surface 30 of the hearth 32. As these pieces are melted by the burners 23, they fall to the dish shaped surface 30. The protruding elements 31 become obstacles to the passage of these solid metal pieces down the slope of the dish 30 and through a channel 33 to the tapping outlet 11 thus preventing large unmelted pieces from reaching and blocking the outlet.

These embodiments are, of course, merely exemplary of the possible changes or variations. Because many varying and different embodiments may be made within the scope of the inventive concept disclosed herein and because many modifications may be made in the embodiments herein detailed in accordance with the descriptive requirements of the law, it should be generally understood that the details herein are to be interpreted as illustrative and not in a limiting sense.

What we claim as the invention is:

1. In a vertical shaft furnace for melting and refining pieces of metal, of the type having an outer furnace wall enclosing an upright melting chamber, a charge entrance opening in the top of said furnace, a plurality of burner openings in the inner surface of said wall for injecting heat into said chamber to melt said metal pieces, and a tapping outlet in the bottom portion of said chamber for discharging molten metal from said furnace, the improvement comprising multiple level hearth means for supporting charge which has descended to the bottom of said melting chamber without being melted and wherein said means comprises a relatively uniform and smooth surfaced multiple level hearth having the shape of multiple domes resting slightly off center in the bottom of said vertical shaft furnace whereby the intersection of said multiple domes and the wall of said furnace is horizontally unlevel so that the point adjacent to said tapping outlet is the lowest level of said multiplel level hearth.

2. The apparatus of claim 1 wherein said multiple domes and a furnace wall cooperate to provide support for metal which has reached said hearth without being melted and wherein the curvature of said multiple domes provides for gravity flow of molten metal toward the outside edges of said domes and said horizontally unlevel juncture of said domes and said wall provides for gravity flow of molten metal around said domes to the lowest level of said multiple level hearth adjacent to said tapping outlet.

3. In a vertical shaft furnace for melting and refining pieces of metal of the type having an outer furnace wall enclosing an upright melting chamber, a charge entrance opening in the top of said furnace, a plurality of burner openings in said wall for injecting heat into said chamber to melt said metal pieces, and a tapping outlet in the bottom portion of said chamber for discharging molten metal from said furnace, the improvement comprising multiple level hearth means for supporting charge which has descended to the bottom of said melting chamber without being melted and wherein said means for supporting charge consists of a relatively uniform and smooth surfaced multiple level hearth having multiple dish snaped depressions with one or more channels sloping downward from their center to a point on the edge of said hearth which is the lowest level of said multiple level hearth and is adjacent to said tapping outlet.

4. The apparatus of claim 3 wherein said dish shaped depressions are located adjacent said burner openings and said channels slope downward along a line generally extending from said burner openings to said tapping outlet.

5. In a vertical shaft furnace for melting and refining pieces of metal of the type having an outer furnace wall enclosing an upright melting chamber, a charge entrance opening in the top of said furnace, a plurality of burner openings in the inner surface of said wall for injecting heat into said chamber to melt said metal pieces, and a tapping outlet in the bottom portion of said chamber for discharging said molten metal from said furnace, the improvement comprising a multiple level hearth having a first upper level for supporting pieces of charge which have reached said hearth without being melted and a second lower level for providing gravity flow paths for said molten metal to said tapping outlet, and wherein said second lower level is formed in the shape of a dish while said first upper level is formed by the tops of numerous refractory charge support elements protruding upward from the surface of the dish.

6. The apparatus of claim 5 wherein said protruding charge support refractory elements are adapted to provide support for charge which has reached said multiple level hearth without being melted, and provide obstacles in the paths of solid charge pieces to limit their lateral movement toward the tapping outlet.

* * * * *